US006125479A

United States Patent [19]

Fraleigh

[11] Patent Number: 6,125,479

[45] Date of Patent: Oct. 3, 2000

[54] FLOOR MOUNTING SYSTEM FOR TOILET STOOLS

[76] Inventor: William T. Fraleigh, One Beach Dr., Suite 1607, St. Petersburg, Fla. 33701

[21] Appl. No.: 09/201,026

[22] Filed: Nov. 30, 1998

[51] Int. Cl.[7] ..... E03D 11/16

[52] U.S. Cl. ..... 4/252.1; 4/252.4; 411/401; 411/402; 411/372.6

[58] Field of Search ..... 4/252.1–252.6; 411/401, 402, 403, 410, 372.6, 374, 429

[56] References Cited

U.S. PATENT DOCUMENTS

| | | | |
|---|---|---|---|
| 1,093,434 | 4/1914 | Kent | 411/402 |
| 1,994,978 | 3/1935 | Brown . | |
| 2,020,522 | 11/1935 | Seguin | 411/374 |
| 3,186,293 | 6/1965 | Curry . | |
| 3,846,851 | 11/1974 | Pepper | 4/252.1 |
| 3,905,052 | 9/1975 | DeAngelis | 4/252.1 |
| 4,185,334 | 1/1980 | Izzi | 4/252.1 |
| 4,515,398 | 5/1985 | Machon, Sr. | 4/252.5 |
| 4,530,629 | 7/1985 | Sakow | 4/252.1 |
| 5,220,694 | 6/1993 | Knorovsky | 4/252.4 |

*Primary Examiner*—Charles R. Eloshway
*Attorney, Agent, or Firm*—Zaley, McKee, Thomte, Voorhees & Sease

[57] ABSTRACT

A floor mounting system for toilet stools has a retaining nut to stabilize the vertical mounted flange bolts to facilitate the lowering of a toilet stool into the vertical bolts. When in position, caps are screwed into a retaining washer on the upper ends of the mounting flange bolts to stabilize the caps, and to protect the bolts against contact with exterior moisture. Internal threads within the cap are threadably mounted on exterior threads on the retaining washer.

3 Claims, 2 Drawing Sheets

FLOOR MOUNTING SYSTEM FOR TOILET STOOLS

BACKGROUND OF THE INVENTION

Toilet stools are typically mounted on two loosely mounted vertical bolts that extend upwardly from a circular flange. The mounting of the stool involves manually lowering the same so that the bolts extend through apertures in the base of the stool. When that is accomplished, nuts are tightened downwardly on the upper ends of the bolts against the base of the stool to rigidly hold the stool in place.

One of the principal difficulties of the foregoing process is that since the bolts are not rigidly held in a vertical position, it is very hard to lower the stool into position on the bolts when even one of the bolts is leaning laterally from a vertical position. This procedure is further complicated by the fact that the installer cannot simultaneously see both mounting bolts at the same time.

A further problem in stool mounting systems dwells in covering the upper exposed ends of the bolts and the nuts therein after the stool has been lowered into the vertical bolts. Typically, plastic or ceramic caps are placed over the upper ends of the bolts. These caps are often displaced during cleaning of the stool. The caps often do not completely cover the apertures in the base of the stool through which the bolts extend. The caps are not watertight, and rust on the bolts soon manifests itself. Putty or adhesive has been placed on the caps to alleviate some of these problems, but that complicates access to the bolts if that ever becomes necessary.

It is therefore a principal object of this invention to provide a system for installing toilet stools that would stabilize the vertical position of the mounting bolts to facilitate lowering the stool on the bolts for mounting purposes.

A further object of this invention is to provide a stable cap for the upper ends of the stool mounting bolts which will completely cover the bolt mounting holes in the stool, which will be rigid with the stool, and which will prevent moisture from contacting and rusting the upper ends of the mounting bolts and the nuts on the upper ends of the bolts.

These and other objects will be apparent to those skilled in the art.

SUMMARY OF THE INVENTION

A floor mounting system for toilet stools has a retaining nut to stabilize the vertical mounted flange bolts to facilitate the lowering of a toilet stool into the vertical bolts. When in position, caps are screwed into a retaining washer on the upper ends of the mounting flange bolts to stabilize the caps, and to protect the bolts against contact with exterior moisture. Internal threads within the cap are threadably mounted on exterior threads on the retaining washer to accomplish this principal.

DESCRIPTION OF THE PREFERRED EMBODIMENT

Figure 1:
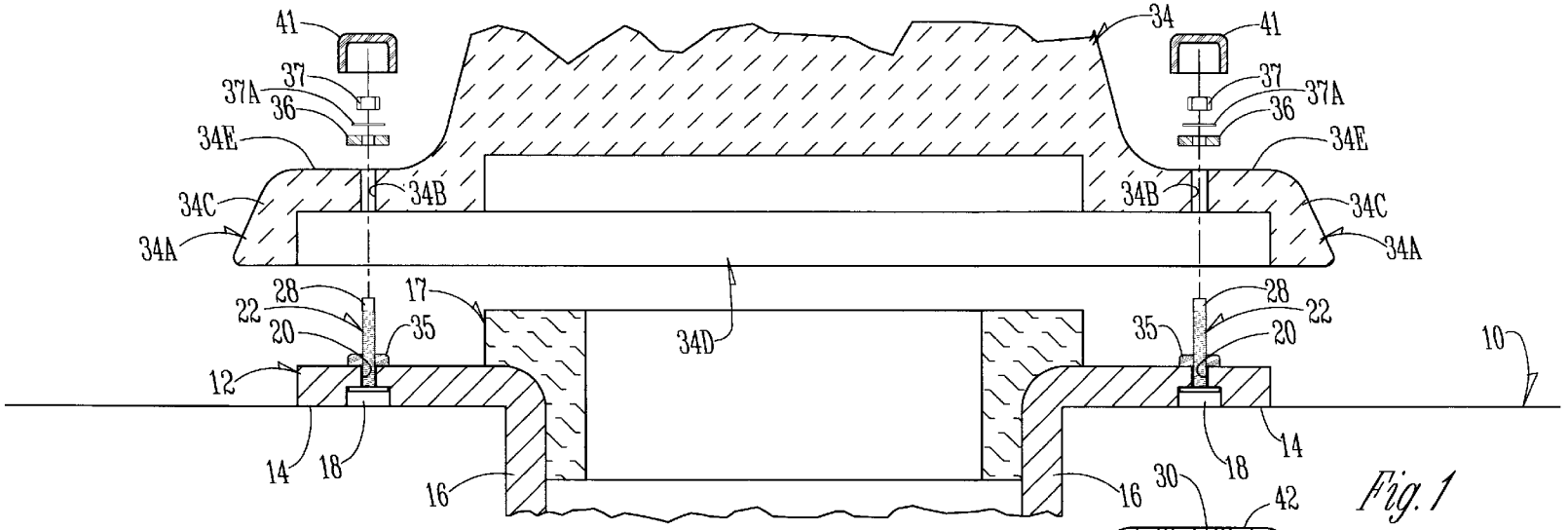
FIG. 1 is an exploded sectional view of the lower portion of the stool and the floor flange.

The numeral 10 designates a floor surface with a conventional floor flange 12 mounted thereon. Flange 12 has a horizontal flange 14 which engages floor 10, and a vertical tube 16 extends downwardly to a sewer pipe (not shown). A conventional wax ring 17 is mounted around a center opening in the floor flange 12 to seal the discharge opening of a toilet stool thereto.

Flange 12 has at least two annular grooves 18 which are on the underside of flange 14 and are open adjacent floor 10. Apertures 20 connect the grooves 18 to the upper surface of the flange 14.

Figure 2:
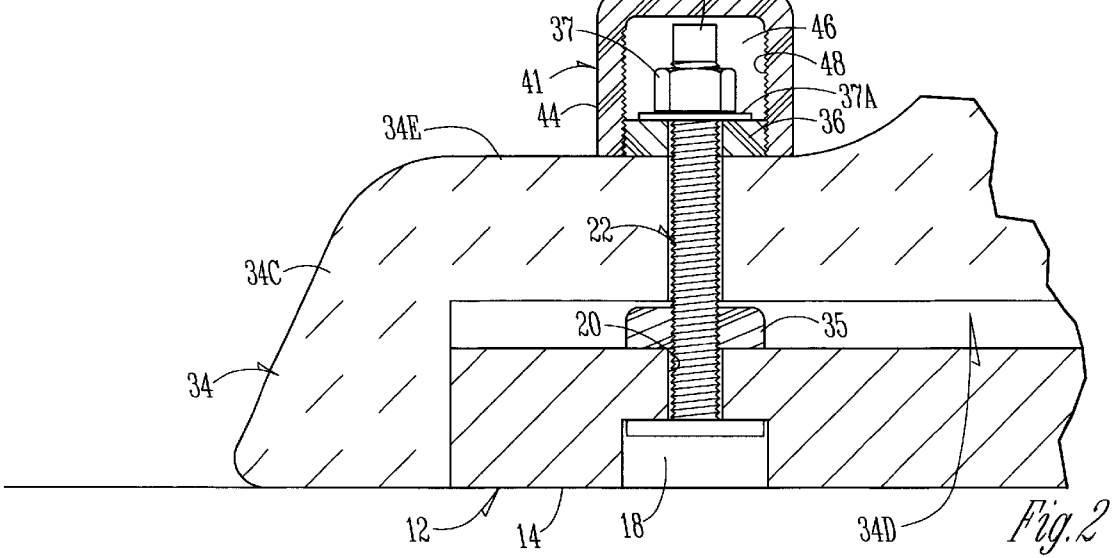
FIG. 2 is a sectional view similar to FIG. 1 showing the lower portion of the stool in its assembled condition with the floor flange.
Figure 3:
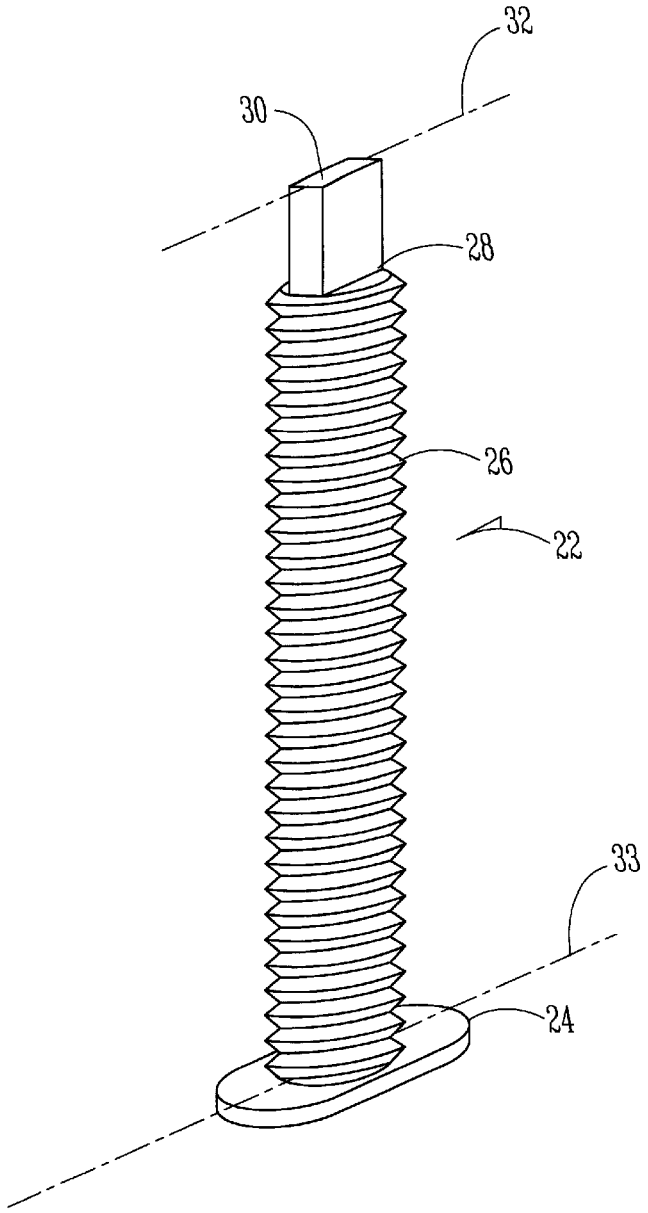
FIG. 3 is a large scale partial perspective view of one of the flange mounting bolts.
Figure 4:
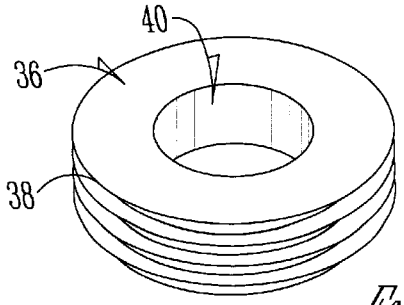
FIG. 4 is an enlarged scale perspective view of a retainer washer for retaining a cap.

Flange mounting bolts 22 with heads 24, threaded shank 26 and an upper end 28 formed into rectangular tip 30 are positioned as shown in FIGS. 1 and 2. The heads 24 engage an upper surface of grooves 18, and shank 26 extends through aperture 20. Tip 30 has a center axis 32 parallel to center axis 33 of head 24 to accomplish the purposes of the flange bolts set forth in my co-pending application Ser. No. 09/143,936 filed Aug. 31, 1998 which is incorporated herein by reference.

A toilet stool 34 (FIGS. 1 and 2) has a conventional base 34A with vertically extending apertures or holes 34B in base or flange 34C. The flange 34C has a recess 34D in its lower central position, and a substantial flat or horizontal upper surface 34E.

A retainer nut 35 is mounted on bolt 22 and is tightened against the upper surface of flange 14 to rigidly hold bolt 22 in a vertical position. Stool 34 is then lowered onto the flange bolts 22 which then extend through holes 34B of base 34C of stool 34. A retainer washer 36 is then placed on the upper ends of bolts 22 to receive cap 41. A lock nut 37 is on top of retainer washer 36 to prevent washer 36 from becoming loosened and to tighten and fasten washer 36, which has a threaded outer surface 38 and an unthreaded center hole 40. The hole 40 receives the bolts 22. (FIG. 2) A brass washer 37A (FIG. 2) may be located under nut 37 if desired.

The cap 41 has a closed top 42, a circular sidewall 44, and a hollow interior 46 including threads 48 which are compatible with the outer threads 38 of washer 36. (FIG. 2) The diameter of cap 41 is sufficient to cover the diameter of holes 34B. The threaded connection between threads 38 on the retainer washer 36 and threads 48 in cap 41 seal the interior 46 of cap 41 from exterior moisture.

It is seen that the nuts 35 stabilize the bolts to facilitate the lowering of stool 34 onto the bolts. Further, the caps 41 protect the bolts 22 from rust, and overcome all the problems associated with conventional bolt caps. Thus, the invention achieves all of its stated objectives.

What is claimed is:

1. A mounting bolt for use in mounting toilet stools, comprising, an elongated bolt having a lower end and an upper end, and an elongated threaded shank therebetween, an enlarged planar head on the lower end having a width at least as large as the diameter of the shank, and a longitudinal length larger than the diameter of the shank, with the longitudinal length being greater than the width, the head having a center axis extending along the longitudinal length, and an indicia mark on the upper end of the bolt visually indicating the position of the center axis to assist the placement and tightening of a threaded nut on the upper end when the position of the head is concealed when a nut is being threadably mounted on the upper end of the bolt, and being comprised of a tip having two parallel long sides and two parallel ends, with the ends being shorter than the sides, said indicia mark having a solid continuous rectangular shape with a center axis between the long sides which is parallel to the center axis of said head.

2. A toilet stool having a horizontal base with a perimeter portion to engage a floor, and a recess opening therein within the perimeter portion, a floor ring fitted within the recess opening and having a perimeter floor-engaging horizontal flange and a center opening thereon in communication with a downwardly extending pipe, the improvement comprising, a pair of oppositely disposed slots in the flange comprised of a wide portion terminating in an elongated narrow portion, the slots extending vertically through the flange, the narrow portion of the slot having a lower edge terminating in a groove and having a width greater than the narrow portion, a bolt having upper and lower ends with the lower end having a planar head thereon positioned in the groove, the head on the bolt having a width similar to that of the narrow portion of the slot and a longitudinal length greater than the width of the narrow portion; the longitudinal length thereof being greater than the width and having a center axis, an indicia mark on the upper end of the bolt visually indicating the position of the center axis to assist the placement and tightening of a threaded nut on the upper end when the position of the head is concealed when a nut is being threadably mounted on the upper end of the bolt, and being comprised of a tip having two parallel long sides and two parallel ends, with the ends being shorter than the sides, said indicia mark having a solid continuous rectangular shape with a center axis between the long sides which is parallel to the center axis of said head.

3. A floor mounting system for a toilet stool, comprising, a toilet stool having an annular extending base adapted to rest on a floor surface, the base having an upper surface, a floor ring positioned within and underneath the base of the toilet stool and also adapted to rest on a floor surface, the floor ring having one or more arcuate grooves in a lower portion thereof; the grooves having an upper surface, registering apertures in the base of the toilet stool and in the floor ring and communicating with the upper surface of the grooves in the floor ring, threaded mounting bolts having upper and lower ends with a head on the lower end engaging the upper surface of the groove in the floor ring, the heads having a longitudinal length and a width, the length being greater than the width, the mounting bolts, the heads on the lower ends of each bolt, and the grooves being of such size that the bolts can be loosely mounted in the grooves but are held against upward movement by the engagement of the heads on the bolts with the upper surface of the groove, retainer nuts on the bolts and threadably tightened thereon against a top of the floor ring to hold the bolts in a vertical position by binding the heads of the bolts against the upper surface of the grooves, a washer having an outer peripheral threaded surface on each of the bolts and resting on the upper surface of the base of the toilet stool, a locking nut on each of the bolts and tightened against the washers to hold the washers in tight engagement with the upper surface of the base of the toilet stool, an internally threaded cap tightly threaded on the outer peripheral threaded surface of the washers and having a lower edge in tight engagement with the upper surface of the base, the heads having a center axis extending along longitudinal length, and an indicia mark on the upper ends of the bolts to visually indicate the position of the center axis to assist the placement and tightening of a threaded nut on the upper ends when the position of the heads is concealed when a nut is being threadably mounted on the upper ends of the bolts, and being comprised of a tip having two parallel long sides and two parallel ends, with the ends being shorter than the sides, said indicia mark having a solid, continuous rectangular shape with a center axis between the long sides which is parallel to the center axis of said head.

* * * * *